US005467818A

United States Patent [19]

Buckley, Jr.

[11] Patent Number: 5,467,818

[45] Date of Patent: Nov. 21, 1995

[54] HEAT EXCHANGER

[75] Inventor: James H. Buckley, Jr., Fort Worth, Tex.

[73] Assignee: Valeo Climate Control Corporation, Fort Worth, Tex.

[21] Appl. No.: 36,324

[22] Filed: Mar. 24, 1993

[51] Int. Cl.[6] ..... F28F 9/06

[52] U.S. Cl. ..... 165/178; 165/176; 165/149

[58] Field of Search ..... 165/78, 149, 176, 165/178, 180

[56] References Cited

U.S. PATENT DOCUMENTS

| | | | |
|---|---|---|---|
| 4,382,859 | 5/1982 | Bouvot | 165/78 |
| 4,586,566 | 5/1986 | Kern et al. | 165/173 |
| 5,014,771 | 5/1991 | Lederer | 165/76 |

FOREIGN PATENT DOCUMENTS

| | | | |
|---|---|---|---|
| 3936918 | 11/1990 | Germany | 165/176 |
| 1601429 | 10/1981 | United Kingdom | F16L 41/08 |
| 2078361A | 1/1982 | United Kingdom | 165/176 |

*Primary Examiner*—Allen J. Flanigan
*Attorney, Agent, or Firm*—Morgan & Finnegan

[57] ABSTRACT

A heat exchanger (2) comprises an end tank (6) defining therein a fluid inlet (16) through which, in use, fluid enters the heat exchanger, and a fluid outlet (20) through which, in use, fluid leaves the heat exchanger (2), a plurality of heat exchange tubes (8) having end portions (10) at which the heat exchange tubes are connected to said end tank (6), a plurality of heat exchange fins (12) connected to the heat exchange tubes (8), a plurality of stubs (28) provided on said end tank (6) extending outwardly therefrom and defining passageways into said end tank, said heat exchange tube end portions (10) being dimensioned to receive said stubs (28), wherein the stubs (28) are each provided with two axially spaced annular grooves (29) on the outer surface thereof, a sealing "O"-ring (30) being seated in each annular groove (29) to provide a seal between the heat exchange tubes (8) and stubs (28).

12 Claims, 6 Drawing Sheets

Fig. 1
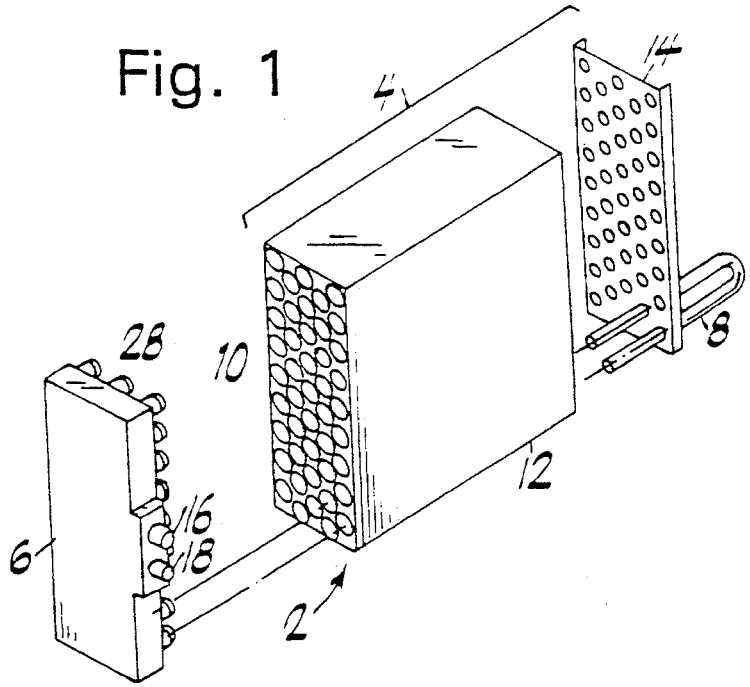
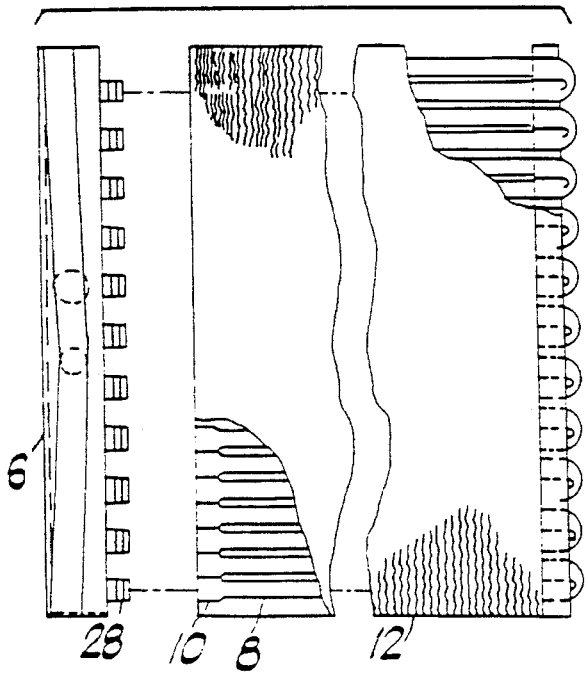
Fig. 2a
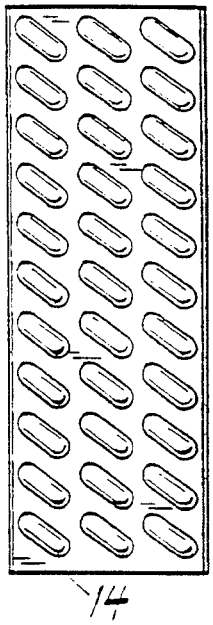
Fig. 2b

Fig. 3
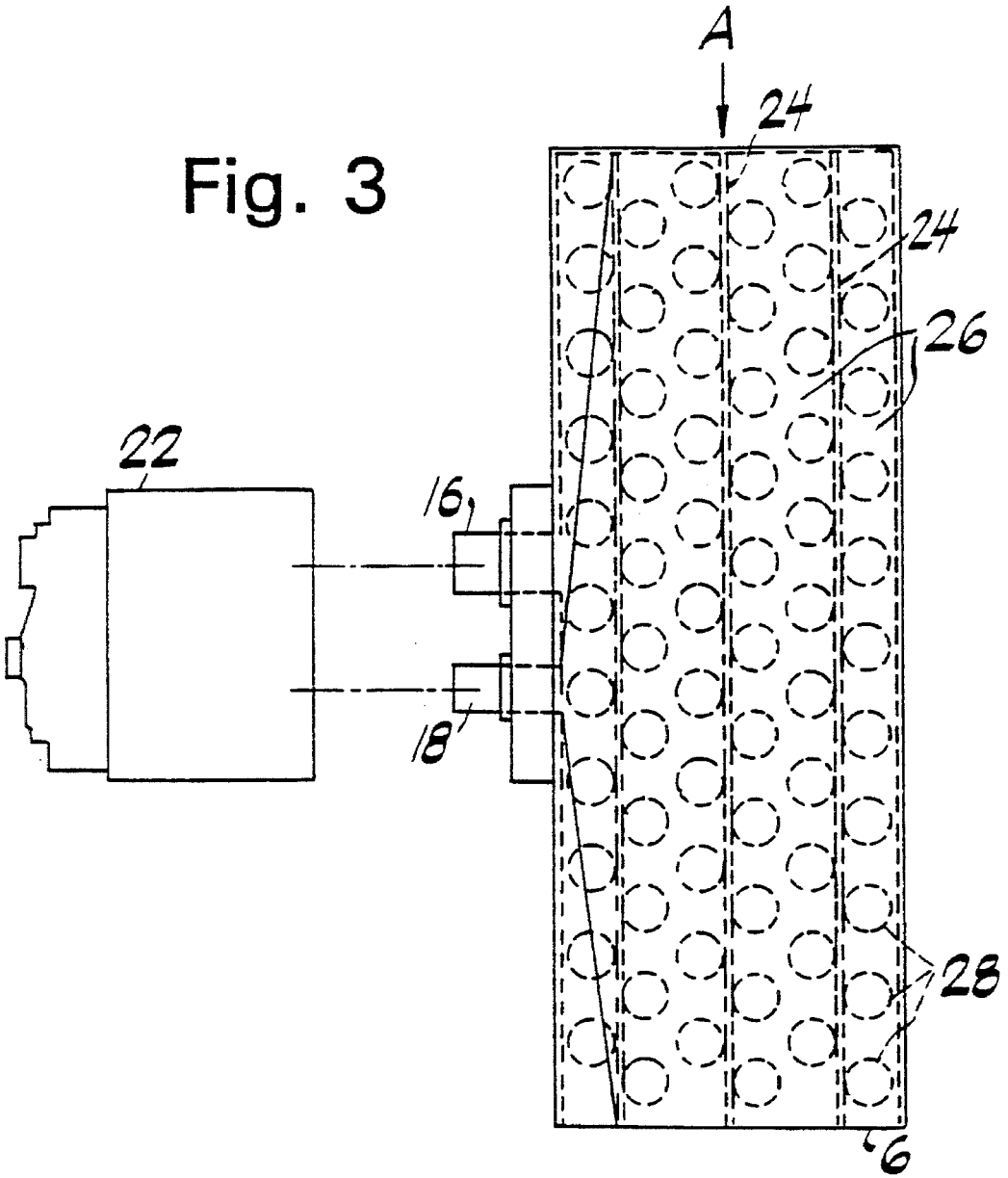
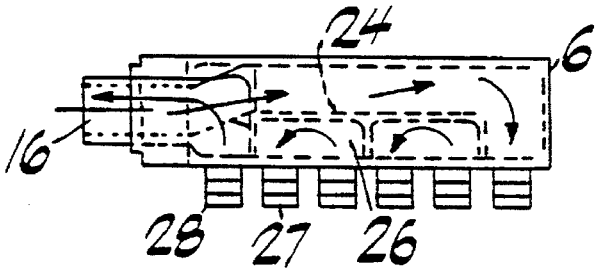
Fig. 4

HEAT EXCHANGER

BACKGROUND OF THE INVENTION

1. Field of the Invention

The present invention relates to a heat exchanger of the tube-fin type for use, in particular but not exclusively, as an evaporator in an automobile air conditioning system.

2. Discussion of the Prior Art

Conventionally, a heat exchanger of the tube-fin type for use as an evaporator or condensor includes a plurality of U-shaped heat exchange tubes on which are arranged a large number of thin metal fins. The heat exchange tubes are connected via inlet and outlet manifolds comprising a plurality of tubular connections, to a coolant fluid inlet or outlet or are connected to return bends, whereby a circulatory path or paths for coolant is defined between the inlet and the outlet.

As an alternative to providing separate return bend connections and manifolds the heat exchange tubes can be connected to a connecting tank or end tank which is provided with an inlet and outlet for connection to the coolant circuit, and which it internally divided so as to define with the heat exchange tubes the circulatory path or paths for the fluid between a fluid inlet and outlet. The heat exchange tubes are connected to the end tank through projecting tubular stubs provided on the end tank which are received within end portions of the heat exchange tubes, an adhesive, or other synthetic hardenable material, being employed to seal the connection. A heat exchanger of this kind is known from British Patent No 1601429. During assembly, recesses defined around the projecting tubular connections are provided with the hardenable material, into which ends of the heat exchange tubes are inserted. A clearance is provided between the projecting tubular connections and heat exchange tubes to allow penetration of hardenable material therebetween.

It is also known to solder or braze the ends of the heat exchange tubes to the projecting stubs.

A drawback of a soldered or brazed joint, or joint employing adhesive or hardenable material is that such joints are susceptible to leakage. Such joints are also liable to become internally restricted or clogged as sealing material enters the tube. When soldering is employed, there are obvious safety risks associated with this technique. These joints are also relatively expensive to produce.

SUMMARY OF THE PRESENT INVENTION

An object of the present invention is to provide a heat exchanger having connections between end tank and heat exchange tubes which overcome the above difficulties and which can be easily and effectively formed.

According to the present invention there is provided a heat exchanger comprising:

an end tank defining therein a fluid inlet through which, in use, fluid enters the heat exchanger, and a fluid outlet through which, in use, fluid leaves the heat exchanger;

a plurality of heat exchange tubes having end portions at which the heat exchange tubes are connected to said end tank;

a plurality of heat exchange fins connected to the heat exchange tubes;

a plurality of stubs provided on said end tank defining passageways into said end tank, said stubs receiving or being received by end portions of respective heat exchange tubes, to form the connection between said end tank and said heat exchange tubes;

wherein sealing "O"-rings are provided between said heat exchange tube end portions and said stubs to provide a seal therebetween, and wherein annular grooves are formed in said heat exchange tube end portions or stubs, within which grooves said sealing "O"-rings are seated.

The above arrangement provides a particularly effective fluid-tight connection between the end tank and heat exchange tubes, which is free of solder or adhesive. A further advantage is that the joints can be disassembled to allow internal cleaning and then reassembled. On assembly, the "O"-rings become compressed to provide an effective fluid-tight seal.

In a preferred embodiment the stubs project outwardly from the end tank and are formed externally with said annular grooves. The heat exchange tube end portions are preferably flared to receive the stubs.

The stubs can alternatively project internally of the end tank, the annular grooves being formed internally on the stubs.

Preferably, said stubs or heat exchange tube end portions which are received within said heat exchange tube end portions or stubs are provided with two axially spaced annular grooves in which are seated respective sealing rings, thereby increasing the effectiveness of the seal.

The end tank may be a plastics end tank having aluminium stubs insert-moulded therein.

In the absence of solder or other hardenable material, it is desirable to provide some further constraint of the heat exchange tubes on the end tank to prevent detachment. Where an end plate is provided to support the heat exchange tubes remote from the end tank, a housing may be provided within which the assembly of end tank, heat exchange tubes, fins and end plate is slidably receivable. The housing may comprise a frame-like housing including a base and opposite end faces which engage the end tank and the end plate respectively.

Alternatively, one or more securing bands may be provided which extend around the entire assembly.

As a further alternative, the end plate may be disposed to support the heat exchange tubes adjacent the end tank, the connection between end plate and end tank being made by crimping.

BRIEF DESCRIPTION OF THE DRAWINGS

Embodiments of the invention will be described, by way of example only, with reference to the accompanying drawings in which:

FIG. 1 is an exploded part-schematic view of a heat exchanger in accordance with the invention;

FIG. 2 is an exploded view of an embodiment of a heat exchanger in accordance with the invention;

FIG. 3 is an end view of the end tank as illustrated in FIG. 2;

FIG. 4 is an end view in the direction of the arrow A in FIG. 3, in which the internal construction of the end tank is visible;

DESCRIPTION OF THE PREFERRED EMBODIMENT

Figure 5A:
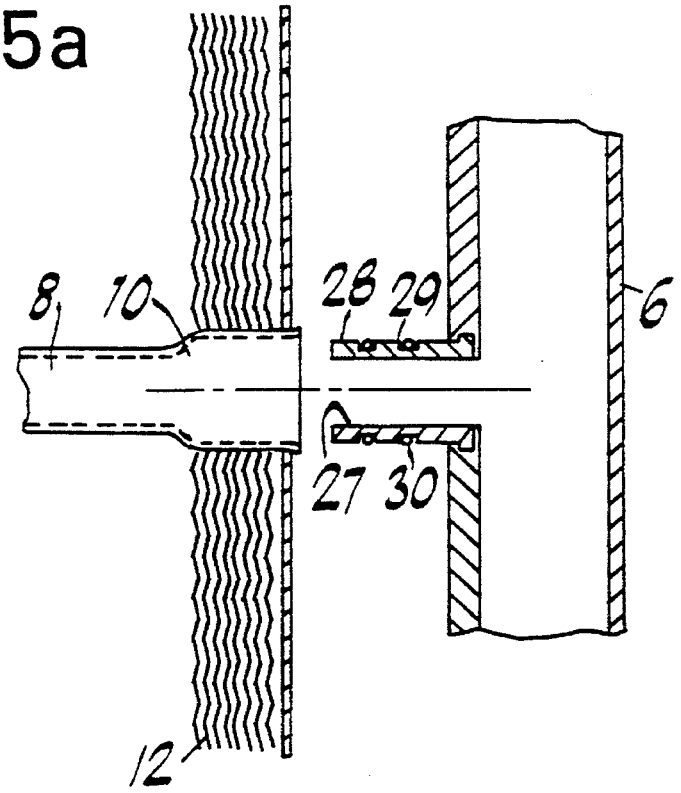
FIGS. 5(*a*) and 5(*b*) are detailed part cross-sectional views of the connection of a heat exchange tube to the end tank prior to and subsequent to assembly.

Turning to the drawings, FIG. 1 shows a simplified exploded view of a heat exchanger in accordance with the present invention.

The heat exchanger 2 essentially comprises a coil block assembly 4 which is connected to an end tank 6. The coil block assembly 4 comprises a plurality of heat exchange tubes 8 each of hairpin shape, ends 10 which are visible in Figure 1, and one of which is shown removed in FIG. 1.

A plurality of aluminium heat exchange fins 12 of conventional form are connected to the heat exchange tubes 8. Various methods of connection can be employed, but preferably the heat exchange tubes are aluminium tubes which are expanded into apertures in the fins by rodding a mandrel therethrough, to form a tight fit in the fin apertures. An end plate 14, preferably also of aluminium, is provided at the opposite side of the coil block assembly 4 from the end tank 6, in order to support the heat exchange tubes 8.

The end tank 6 is a plastics injection-moulded tank having a tubular fluid inlet 16, and a fluid outlet 18. In use the end tank 6 is connected through an expansion valve 22 to a coolant fluid circuit. The end tank 6 comprises a plurality of internal partitions 24 defining therein a plurality of compartments 26, as seen in FIGS. 3 and 4. Passageways into the end tank compartments 26 are defined through openings 27 in a face of the end tank which is provided with outwardly protruding tubular stubs 28. The stubs 28 are preferably formed of short tubular portions of aluminium or copper, which are machined and then inserted-moulded with the end tank 6, although the stubs 28 can be unitarily moulded in plastics with the end tank 6.

The end tank 6 is preferably formed by a "lost-core" method where a polymer is injected into a mould which has been preloaded with an injection moulded core of low melting point metal which is subsequently melted out to leave the hollow end tank. This method is particularly suitable for providing the relatively complex internal tank shape.

Figure 5B:
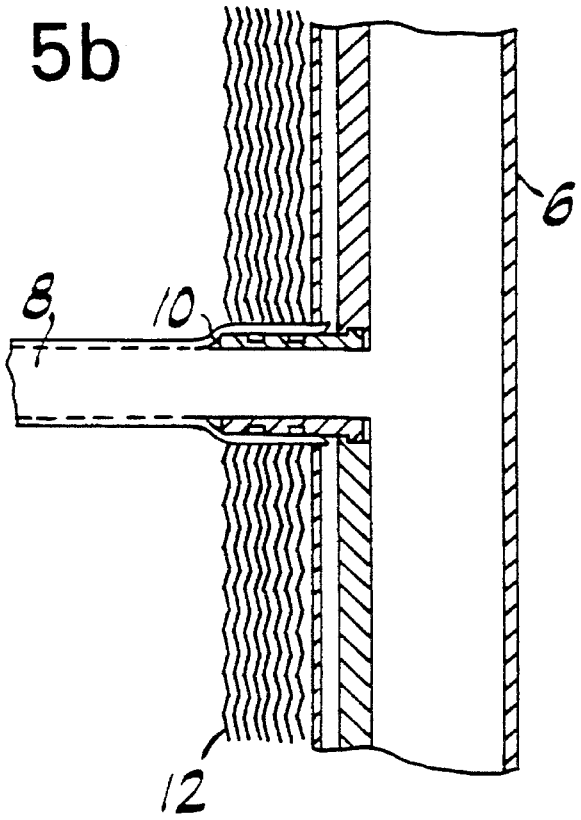

The heat exchange tubes 8 are provided with flared or "belied" end portions 10 dimensioned to receive the stubs 28, best seen in FIG. 5. The stubs 28 are each formed with a pair of annular axially spaced grooves 29 on their outer surfaces within which are seated respective sealing "O"-rings 30. The connection between heat exchange tubes 8 and respective stubs 28 is a push-fit, whereby the "O"-rings are compressed within the grooves 29, to thereby form an effective fluid-tight seal.

Figure 7:
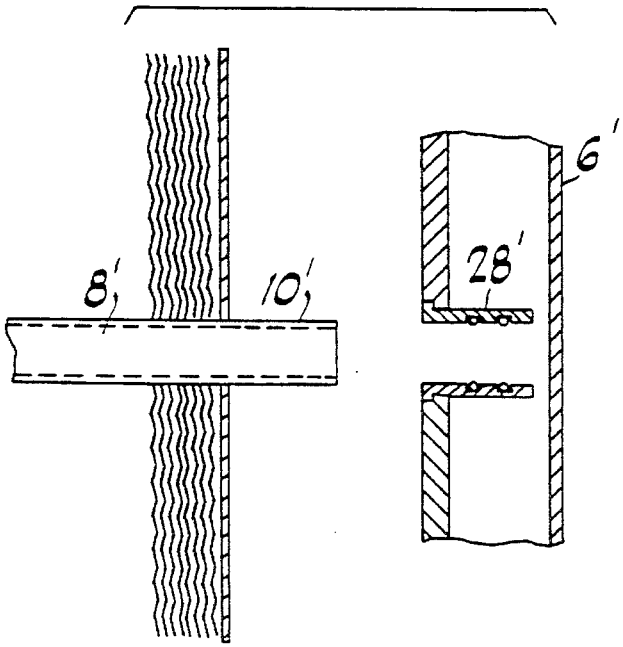
FIG. 7 is a detailed cross-sectional view of an alternative manner of connection of a tube to end tank.

As an alternative to the above described arrangement it will be appreciated that these stubs 28 could instead be dimensioned to receive end portions 10 of the heat exchange tubes 8. As a further alternative the stubs could be arranged to extend inwardly of the end tank, with the heat exchange tube end portions dimensioned to be received within the stubs, as shown in FIG. 7. Here an end portion 10' of a heat exchanger tube 8' is received within the inwardly projecting stub 28'. Instead of forming the grooves on the stubs, these could be formed on the heat exchange tube end portions, internally thereof where these receive the stubs, or externally where these are received by the stubs.

Figure 6A:
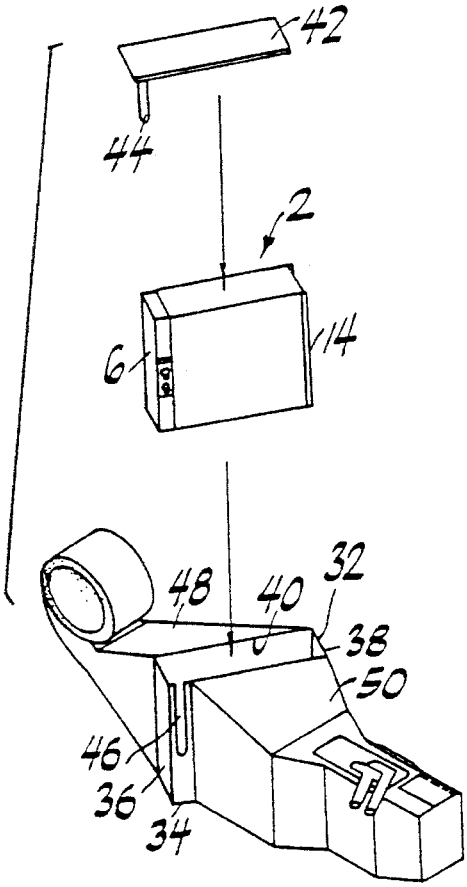
FIGS. 6(*a*) and 6(*b*) show an evaporator assembly having a housing for receiving the heat exchanger, prior to and subsequent to insertion of the heat exchanger.
Figure 6B:
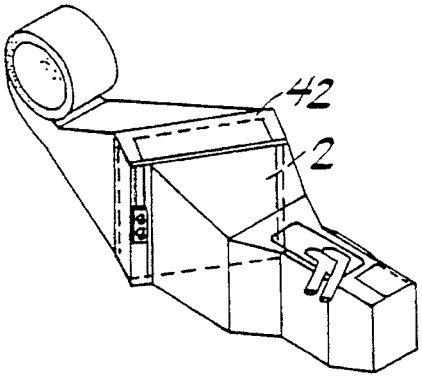

Further securement of the end tank 6 to the coil block assembly 4 is achieved by providing a cassette-type housing arrangement within which the assembled heat exchanger is slidably receivable, so as to provide support in the axial direction of the heat exchange tubes 8 and stubs 28 to ensure the connection is maintained. As shown in FIG. 6 the housing comprises a frame-like slide mount 32 comprising a base 34 and end portions 36,38 which engage the end tank 6 and end plate 14 to prevent detachment of the heat exchange tubes 8 from the end tank 6, and an opening 40 through which the heat exchanger is introduced into the mount 32. A housing cover plate 42 is provided to close the opening 40, and includes a tongue 44 for engagement within a groove 46 provided in the mount 32. FIG. 6 also shows the mount as arranged between a conventional air blower housing 48 and an air distribution housing 50.

Figure 8A:
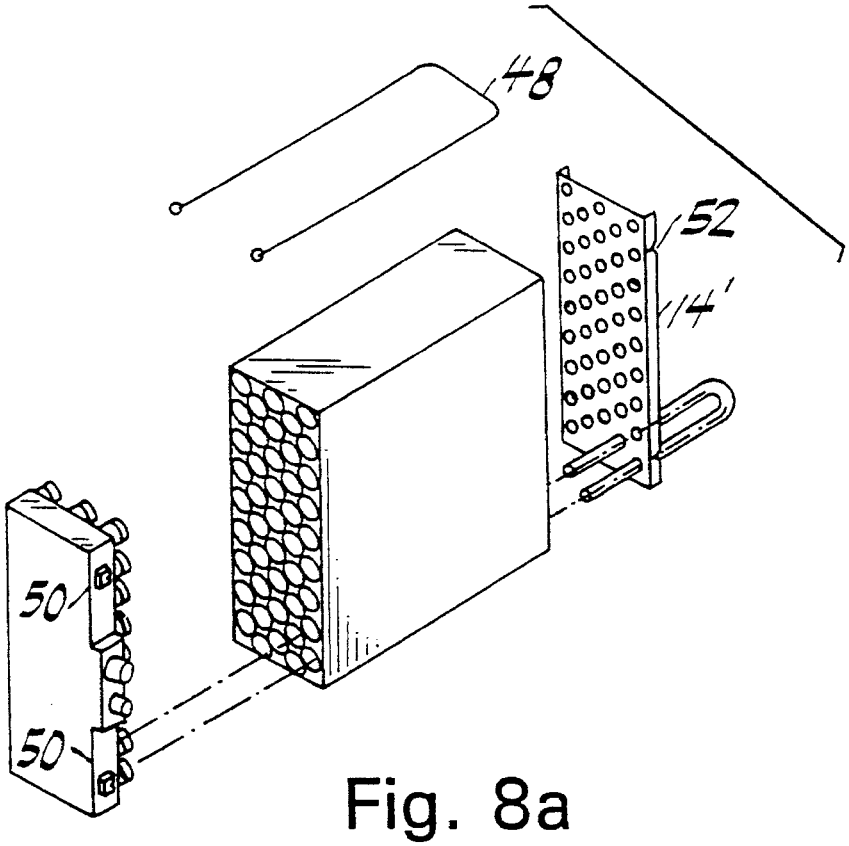
FIGS. 8(*a*) and (*b*) are exploded and assembled views of a further embodiment of the invention showing an alternative manner of connection of end tank to coil block assembly.
Figure 8C:
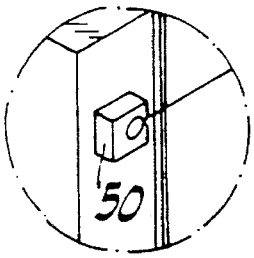
Figure 8B:
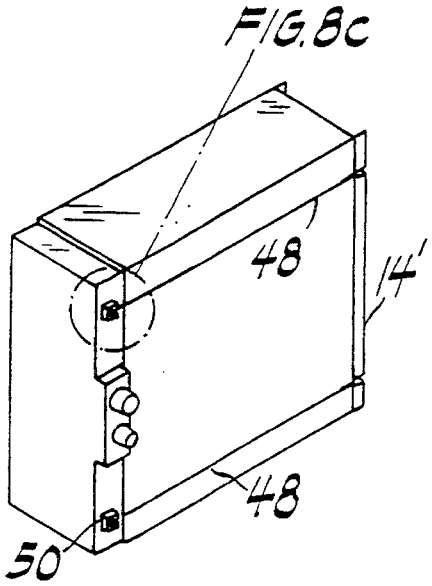

As an alternative to this housing, as is shown in FIGS. 8(*a*) and (*b*) circumferential tensile bands 48, for example formed of steel or nylon, may be secured around the heat exchanger in order to provide the axial support. The bands 48 are secured on the end tank at mounting points 50, and extend about the heat exchange tubes/fins and end plate 14', being seated in slots 52 in end flanges of the end plate 14'.

Figure 9A:
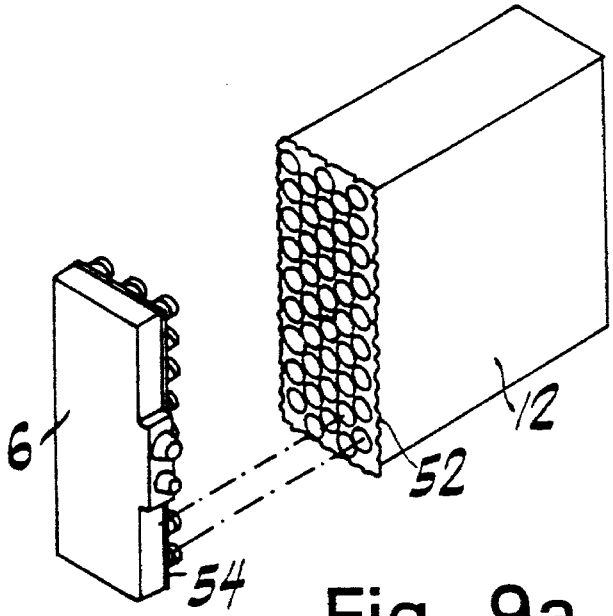
FIGS. 9(*a*) and (*b*) are exploded and assembled views of a still further embodiment of the invention exhibiting a still further alternative manner of connection.
Figure 9C:
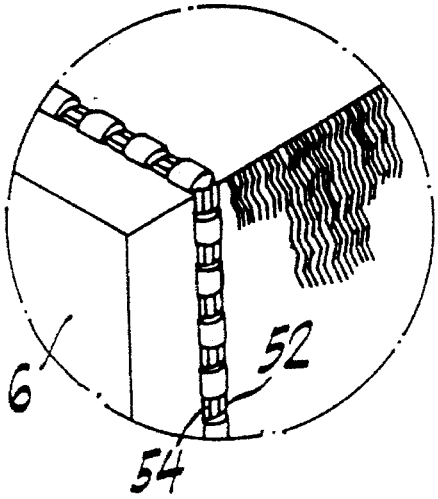
Figure 9B:
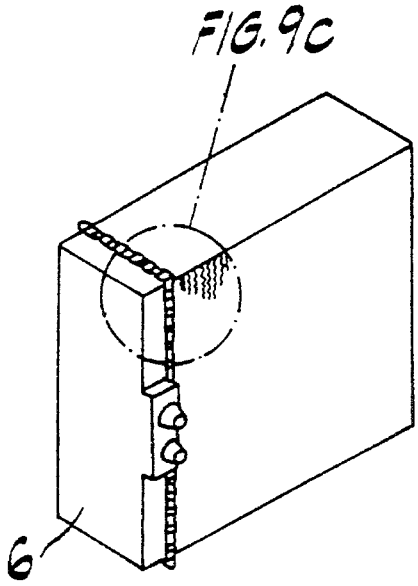

As a further alternative, shown in FIGS. 9(*a*) and (*b*), an end plate 52 is provided adjacent the end tank 6 and provided with a slotted edge. The end tank 6 is here provided with a raised flange 54 moulded into the end tank, the end tank 6 and heat exchanger assembly being secured together by crimping, as best seen in the detail of FIG. 9(*b*).

Advantages of the described heat exchanger are that avoidance of soldering, or use of an adhesive or other hardenable material results in a more effective fluid-tight connection in which the problems of leakages are reduced and problems of internal clogging of passageways are avoided. The avoidance of additional sealing material also facilitates automation of the assembly process. The connections can also be disassembled, the end tank 6 being removed from the heat exchange tubes 8, in order to allow internal cleaning of the tubes and tank, while still allowing subsequent reassembly.

Use of a plastics end tank 6 allows provision of an end tank having a lower profile than the present conventional arrangement employing an assembly of manifolds and return bends, allowing further utilisation of the space taken up by the heat exchanger for the provision of the heat exchange surfaces, thereby increasing the efficiency of the heat exchanger.

Conventionally, the heat exchanger is seated within the air duct between air blower and air distribution housing by engagement within locating lugs in the duct. Employing a cassette-type housing facilitates insertion of the heat exchanger, and in addition, overcomes the need for sealing material to be disposed around the heat exchanger, which is generally employed to ensure complete air flow through the heat exchanger.

What is claimed is:

1. A heat exchanger comprising:

an end tank defining therein a fluid inlet through which, in use, fluid enters the heat exchanger, and a fluid outlet through which, in use, fluid leaves the heat exchanger:

a plurality of heat exchange tubes having end portions at which the heat exchange tubes are connected to said end tank:

a plurality of heat exchange fins connected to the heat exchange tubes;

a plurality of stubs provided on said end tank defining passageways into said end tank, said stubs receiving or being received by end portions of respective heat exchange tubes, to form the connection between said end tank and said heat exchange tubes;

wherein sealing "O"-rings are provided between said heat exchange tube end portions and said stubs to provide a seal therebetween, and wherein annular grooves are formed in said heat exchange tube end portions or stubs, within which said grooves said sealing "O"-rings are seated; and wherein said end tank is a plastic end tank having aluminum stubs insert-moulded therein.

2. A heat exchanger according to claim 1 wherein the annular grooves are provided on the stubs.

3. A heat exchanger according to claim 1 wherein the stubs project outwardly from the end tank, and are formed externally with said annular grooves.

4. A heat exchanger according to claim 3 wherein the heat exchange tube end portions are flared tube end portions which receive the stubs.

5. A heat exchanger according to claim 1 wherein the stubs project internally of the end tank, said annular grooves being formed internally of the stubs.

6. A heat exchanger according to claim 1 in which each said stub or heat exchange tube end portion connected therewith is provided with two axially spaced annular grooves in which are seated respective sealing "O"-rings.

7. A heat exchanger according to claim 1 in combination with a housing in which the heat exchanger is Slidably receivable, said housing serving to prevent detachment of the heat exchange tubes from the end tank.

8. A heat exchanger according to claim 7 wherein an end plate is provided to support the heat exchange tubes at a region remote from the end tank, and wherein said housing is a frame-like housing comprising a base and opposite end faces which engage the end tank and the end plate respectively.

9. A heat exchanger according to claim 1 further comprising one or more securing bands extending around the end tank and heat exchanger tubes to prevent detachment of the tubes from the end tank.

10. A heat exchanger according to claim 1 wherein an end plate is provided to support the heat exchange tubes at a region adjacent the end tank, and wherein said end plate is connected to said end tank by crimping, thereby preventing detachment of the heat exchange tubes from the end tank.

11. A heat exchanger comprising:

an end tank defining therein a fluid inlet through which, in use, fluid enters the heat exchanger and a fluid outlet through which, in use, fluid leaves the heat exchanger;

a plurality of heat exchange tubes having end potions at which the heat exchange tubes are connected to said end tank;

a plurality of heat exchange fins connected to the heat exchange tubes;

a plurality of stubs provided on said end tank extending outwardly therefrom and defining passageways into said end tank, said heat exchange tube end portions being dimensioned to receive said stubs;

wherein said stubs are each provided with two axially spaced annular grooves on the outer surface thereof, and wherein a scaling "O"-ring is seated in each annular groove to provide a seal between the heat exchange tubes and stubs; and wherein said end tank is a plastic end tank having aluminum stubs insert moulded therein,

12. A heat exchanger assembly comprising:

an end tank defining therein a fluid inlet through which, in use, fluid enters the heat exchanger and a fluid outlet through which, in use, fluid leaves the heat exchanger;

a plurality of heat exchange tubes having end portions at which the heat exchange tubes are connected to said end tank;

a plurality of heat exchange fins connected to the heat exchange tubes;

an end plate disposed remote from said end tank to support the heat exchange tubes;

a plurality of stubs provided on said end rank extending outwardly therefrom and defining passageways into said end tank, said heat exchange tube end portions being dimensioned to receive said stubs;

a frame-like housing comprising a base and opposite end faces within which the end tank, heat exchange tubes, heat exchange fins and end plate are slidably receivable, whereby said opposite end faces engage the end tank and end plate respectively to prevent detachment of the heat exchange tubes from said stubs;

wherein said stubs are each provided with two axially spaced annular grooves on the outer surface thereof, and wherein a sealing "O"-ring is seated in each annular groove to provide a seal between the heat exchange tubes and stubs; and wherein said end tank is a plastic end tank having aluminum stubs insert-moulded therein.

* * * * *